United States Patent [19]

Pollack

[11] 4,317,421

[45] Mar. 2, 1982

[54] MOORING LINE HANDLING APPARATUS

[75] Inventor: Jack Pollack, Winfield, Ill.

[73] Assignee: Chicago Bridge & Iron Company, Oak Brook, Ill.

[21] Appl. No.: 31,769

[22] Filed: Apr. 20, 1979

Related U.S. Application Data

[62] Division of Ser. No. 868,814, Jan. 12, 1978, Pat. No. 4,178,870.

[51] Int. Cl.[3] ..... B63B 21/00

[52] U.S. Cl. ..... 114/230; 441/3; 242/107; 254/364

[58] Field of Search ..... 114/205, 213, 230, 293, 114/254, 102, 251, 248; 9/8 P; 254/149, 165, 172, 178, 185, 183, 187.7, 198, 364; 267/69, 73; 242/75.3, 75.42, 75.43, 147 R, 155 R, 107

[56] References Cited

U.S. PATENT DOCUMENTS

| | | | |
|---|---|---|---|
| 458,938 | 9/1891 | Bloomfield | 242/107 |
| 1,811,400 | 6/1931 | McClellan | 114/230 |
| 2,470,059 | 5/1949 | Watson et al. | 254/173 R |
| 2,712,919 | 7/1955 | Calvert | 267/73 |
| 3,129,688 | 4/1964 | Buchholz | 114/230 |
| 3,802,375 | 4/1974 | Janssen | 114/251 |
| 3,913,157 | 10/1975 | Versluis et al. | 9/8 P |
| 3,980,037 | 9/1976 | Tuson | 9/8 P |

OTHER PUBLICATIONS

Bohannan, *Nylon Makes Ideal Dock Line but Dacron's Best for Towing*—Hall Syndicate, 1969.

*Primary Examiner*—Trygve M. Blix
*Assistant Examiner*—Jesus D. Sotelo
*Attorney, Agent, or Firm*—Merriam, Marshall & Bicknell

[57] ABSTRACT

A mooring line handling apparatus comprising a small diameter sheave, a large diameter sheave, the small sheave and the large sheave being axially mounted on a shaft secured to a base, a first line wrapped for at least part of its length on the large sheave, and an elastic line extending from an anchor to the small sheave for resisting rotation, by the elasticity of the elastic line, of the large sheave when a load is applied to unwrap the first line. A plurality of elastic lines of equal length can be used. Another version of mooring line handling apparatus has a lever pivotably secured to a base, a mooring line attached to a first end of the lever, and an elastic line extending from the anchor to the second end of the lever. A load applied to the mooring line pivots the lever which stretches the elastic line thereby effectively increasing the mooring line length as a load is applied.

3 Claims, 12 Drawing Figures

MOORING LINE HANDLING APPARATUS

This is a division of application Ser. No. 868,814, filed Jan. 12, 1978, now U.S. Pat. No. 4,178,870 granted Dec. 18, 1979.

This invention relates to ship mooring systems and apparatus. More particularly, this invention concerns a line handling apparatus and its use in mooring ships.

Large ships, and particularly oil tankers, must occasionally be moored to offshore structures or towers which oscillate horizontally 30 feet or more due to waves. Because of the large size of these ships, their oscillatory motions resulting from waves are relatively small when compared to the tower motions induced by waves. These ships, however, will drift due to forces induced by currents, wind and waves. The mooring hawser extending from the tower to the ship must accommodate both the steady drift force of the ship on the tower and the difference in motion between the wave induced oscillatory motions of the ship and tower or it may break. The lines used for such mooring quite often are hawsers of braided nylon of about six to ten inches in diameter. Nylon hawsers are moderately elastic and can repeatedly stretch up to about 10% of their length without failing. Such a hawser 600 feet long will stretch 60 feet and thus could accommodate large oscillations by an offshore mooring tower without breaking. However, it is undesirable to have a ship moored so far from a tower or similar structure because of the difficulty in handling such a long heavy hawser and in running such a long oil flow hose from the tower to the ship, bearing in mind that such a hose could be about 10 to 24 inches in diameter. There is thus a need for improved ship mooring systems and mooring line handling apparatus.

According to one aspect of the present invention there is provided a mooring line handling apparatus comprising a small diameter sheave and a large diameter sheave with both sheaves axially mounted on a shaft secured to a base, a first line wrapped for at least part of its length on the large sheave, elastic line means extending from an anchor means to means connected to the small sheave for resisting rotation, by means of the elasticity of the at least one elastic line, of the large sheave when a load is applied to unwrap the first line. The elastic line means is calculated to bear a maximum load, when stretched to a predetermined length below the elastic limit of the line means equal to the load applied in unwrapping a predetermined length of the first line from the large diameter sheave multiplied by the ratio of the diameter of the large sheave to the diameter of the small sheave.

The elastic line means can be a single line of adequate load capacity and suitable elasticity or it can be a plurality of lines, desirably arranged parallel to one another, and of equal length so that each bears its proportionate share of the applied load.

Regardless of whether a single elastic line or plurality of such lines are used it is advisable to operatively connect such lines indirecty to the small sheave to avoid wrapping the lines on the sheave. Direct wrapping of the lines on the sheave is generally not desirable because the diameter of the lines would be quite large relative to the diameter of the small sheave and this would induce uneven stresses in the lines and premature failure. It is accordingly considered advantageous to extend the elastic line or lines from an anchor means to a junction bar where they are securely joined. Separate means is then provided to operatively connect the junction bar to the small sheave. One such means is a gear rack which is operatively joined to the junction bar and extends to a pinion gear used in place of the small sheave. Another means which can be used is a series of chains which mesh with teeth on the small sheave.

Regardless of the means used to operatively join the elastic lines to the small sheave it is desirable to pretension the elastic lines slightly to hold them in position and to prevent them from whipping when an initial load is applied on the first line on the large sheave. Once pretensioning of the lines is effected it can be maintained by a stop block against which the junction bar can bear. Of course, other means can be used to keep the lines pretensioned.

The elastic lines are desirably made from a suitable polymeric material which is moderately elastic, i.e., has an elastic limit up to about 25%. Lines made of more elastic material, such as rubber, would stretch too much to provide the desired load resistance within a suitable length. Nylon and polypropylene are suitable materials for the elastic lines. Commercially available nylon hawsers are particularly useful in the invention.

The mooring line handling apparatus is particularly suitable for use in combination with the mooring of a ship, particularly to an offshore horizontally oscillating tower. When used on such a tower for mooring a ship, which remains relatively stationary because of its size but which is subject to a steady drift force, the length of the first line, which can be a hawser, to be unwrapped from the large sheave would approximately equal the amount of line that would be pulled out by the tanker steady drift force plus an additional length that would roughly equal one-half of the dynamic horizontal tower movement. The first line length pulled out is predetermined to approximatley equal the ratio of the diameters of the large sheave or a pinion gear to the small sheave multiplied by the distance the elastic line or lines stretch, this distance being less than the elastic limit of the line or lines.

The invention also provides mooring line handling apparatus in which a lever is used to obtain a mechanical advantage and a sheave or two alternatively may be included. Thus, in another aspect of the invention, there is provided a mooring line handling apparatus comprising a lever pivotably secured to a base, a mooring line attached to a first end of the lever, an anchor means spaced-apart from the lever, and elastic line means extending from the anchor means to a second end of the lever. A load applied to the mooring line pivots the lever which stretches the elastic line means, thereby effectively increasing the mooring line length as a load is applied, such as by a ship.

This second type of apparatus may also be mounted on an offshore horizontally oscillating structure, such as a tower resting on the sea floor and having a universal joint at or near the bottom. It is intended that the elastic line means be able to stretch a distance which when multiplied by the distance from the lever pivot to the lever end to which the mooring line is attached be equal to the distance from the lever pivot to the lever end to which the elastic line means is attached multiplied by the length of elongation required to keep the ship moored. The length of elongation required to keep the ship moored is equal to the amount of system elongation caused by the steady force pull of the ship plus a distance equal to one-half of the dynamic oscillation distance of the tower minus any elongation of the mooring line.

In a third aspect of the invention there is provided a mooring line handling apparatus which comprises a sheave, generally a very large sheave, axially mounted on a shaft secured to a base, a first line wrapped for at least part of its length on the sheave, and elastic line means extending from an anchor means to the first line for resisting by means of the elasticity of the elastic line means, unwrapping of the first line from the sheave when a load is applied to the first line. The elastic line means desirably includes at least one elastic line extending from the first line to one end of a pivotally mounted lever, and at least one second elastic line extending from the other end of the lever to the anchor means.

Each of the mooring line apparatus described above can be used to moor a ship to an oscillating offshore structure. They can also be used on a fixed-in-place or stationary structure which does not move or oscillate to moor a ship of a size that can move in response to waves.

The invention will be described further in conjunction with the attached drawings, in which.

So far as is practical the same numbers will be used to identify the same or similar elements in the drawings.

Figure 1:
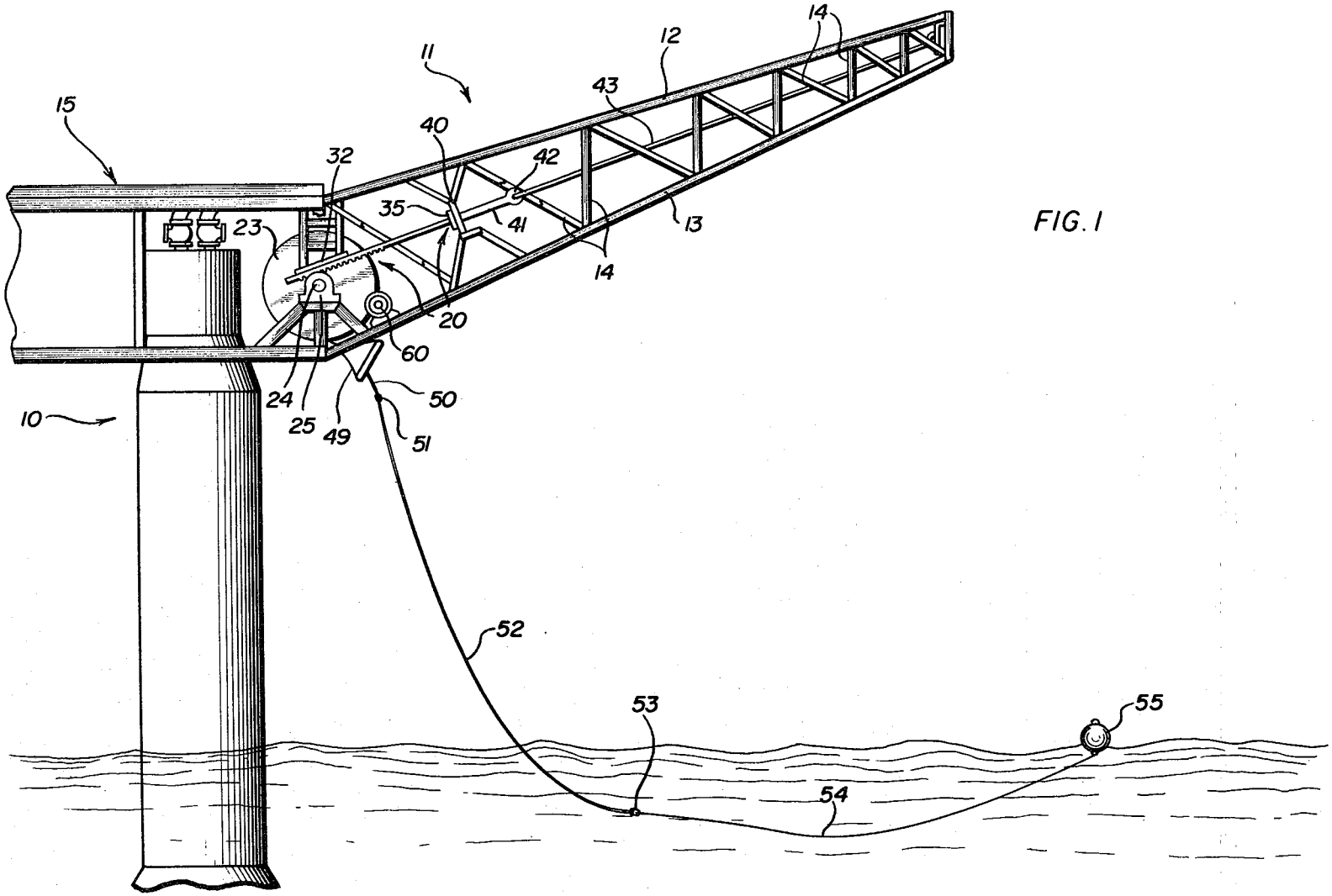
FIG. 1 is a side elevational view of an offshore tower having a boom for mooring a ship and loading oil with a mooring line handling apparatus in the boom.

With reference to FIG. 1 the offshore oscillating tower 10 rests on the sea floor. The tower has a universal joint at its base and is provided with a platform 15 having an outwardly and upwardly extending boom 11 of open framework structure having top and bottom chords 12 and 13 to which trusses or crossbraces 14 are joined thus forming a strong structure having low wind resistance. The tower and boom are intended to contain equipment for transferring oil from the tower to a ship moored to the tower. Such equipment is not shown in the drawings because it does not pertain to the invention.

Mounted in boom 11 is mooring line handling apparatus 20 which contains in part, a pair of small diameter pinion gears 21 and 22 on each side of a large diameter sheave 23. Both the small diameter pinion gears 21 and 22 and the large diameter sheave 23 are axially fastened to shaft 24 rotatably mounted on base 25 located in the boom near where it joins the tower platform 15.

Figure 2:
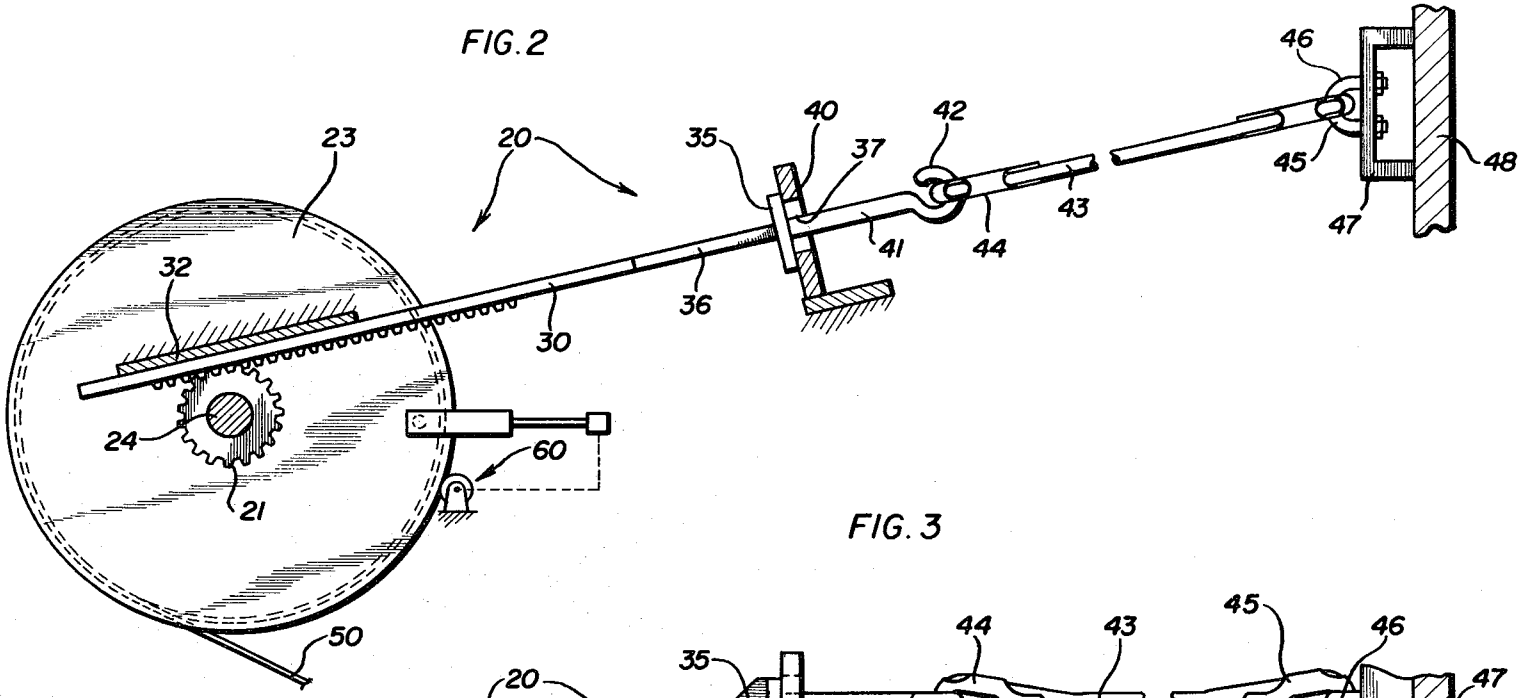
FIG. 2 is an enlarged side elevational view of the mooring line handling apparatus shown in FIG. 1 with the boom structure excluded for clarity.
Figure 3:
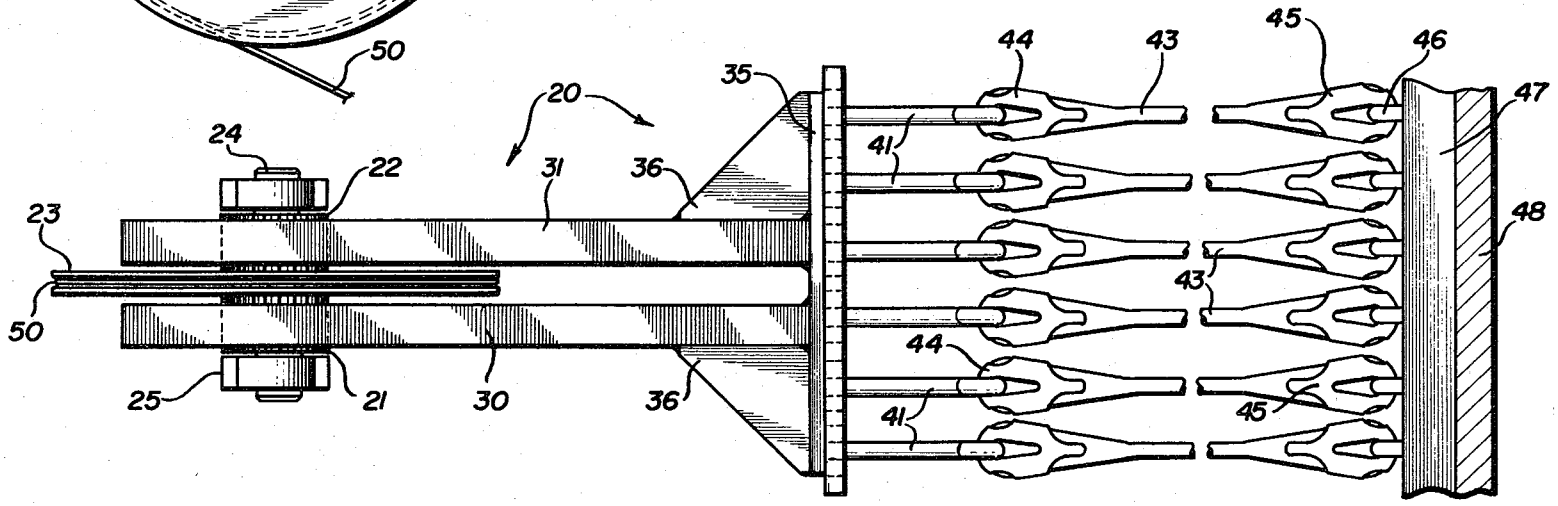
FIG. 3 is a plan elevational view of the mooring line handling apparatus shown in FIGS. 1 and 2.

Gear racks 30 and 31 are located to mesh with pinion gears 21 and 22 respectively on each side of large sheave 23 (FIG. 3). Each gear rack 30 and 31 is held in place by a rack guide 32 (FIGS. 1 and 2). The two gear racks extend to, and are joined to, junction bar 35 and the connection is reinforced by braces 36.

Stop block 40 is fixedly secured in boom 11 and it is intended that junction bar 35 be in pressure contact with it when the mooring line handling apparatus is not in use mooring a ship. A series of spaced apart rods 41 in the same inclined panel extend through over-sized holes 37 (FIG. 2) in stop block 40 and are joined to junction plate 35. Each rod 41 has a hook 42 at the end. An elastic line typified by a nylon hawser 43 if joined to each hook 42 by a spliced loop in a thimble 44 and to U-bolt 46 by a spliced loop in a thimble 46. The U-bolts 46 are joined to channel member 47 connected to plate 48 fixedly located at the outer end of the boom. The U-bolts 46 can be made long enough to pretension the hawsers 43 after they are put in position to keep junction bar 35 in contact with stop block 40. Although the embodiment of the invention illustrated by FIG. 3 employs six hawsers 43 of equal length, more or less than six can be used so long as the number of hawsers employed is correlated with their size, length and tensile strength to provide the desired resistance to the load applied by wire rope 50 to gear racks 30 and 31. The total load imposed on these hawsers will be higher than the load on the single line hawser by a ratio of the diameters of the large sheave and pinion gears. As an example, if the single hawser were sized for the maximum imposed load and the sheave to pinion gear ratio were 4:1, four hawsers would be required in parallel or a larger hawser of 4:1 load rating would be required for attachment to the pinion gear. Also, using the same example, for every 4 feet the ship to structure distance varied, the multiple hawsers would only elongate one foot. The multiple hawsers require less length on the structure and are subjected only to such length elongations which would not greatly decrease their life expectancy.

Wire rope 50 is wrapped around large sheave 23 and it extends though bell 49 to coupling 51 before any ship is moored to the tower. Ship mooring nylon hawser 52 is joined to coupling 51 and to coupling 53, and messenger line 54 is joined to coupling 53 and to buoy 55 which floats in the water.

To moor a ship 130 to tower 10 as shown in FIG. 2, the messenger line 54 and buoy 55 are pulled to the ship deck. By means of a winch on the ship the hawser 52 is pulled up onto the deck and fastened to the ship thereby completing the ship mooring. When the ship is to be unhooked from the tower the hawser 52 is released from the ship and dropped overboard by means of the messenger line which is then in turn dropped overboard with the buoy 55. In the event that the mooring line composed of items 50, 51, 52 and 53 breaks or is released too rapidly by the tanker during unhooking, velocity limiting brake 60 will control the rotation of sheave 23 which rewinds wire rope 50.

The described hawser handling apparatus provides a solution to the problem of accommodating a large elongation with a low spring constant to avoid excessive loads on the hawser.

In a variation of the invention the large sheave can be counterweighted or driven so that some predetermined length of wire rope is spooled onto it after a ship releases the hawser and after the junction bar 35 has returned into contact with stop block 40. The large sheave, for this variation to be operable, would be freewheeling on shaft 24 during this part of the rewinding and subsequent unspooling or paying out of the predetermined length of wire rope. Once the predetermined distance of wire rope is paid out a catch means on the large sheave can engage the pinion gears 21 and 22 to thereby transfer further loads from the large sheave to the hawser 43.

FIGS. 4 to 9 show four additional embodiments of the invention, all of which employ a lever in conjunction with a sheave to accomplish motion advantages which can be put to use in mooring a ship.

Figure 4:
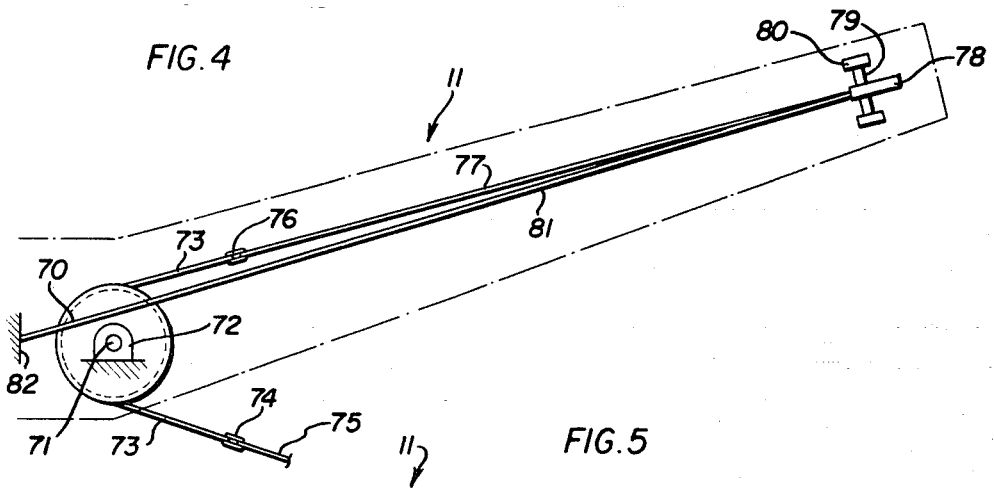
FIG. 4 is a side elevational view of a second embodiment of mooring line handling apparatus in a boom.
Figure 5:
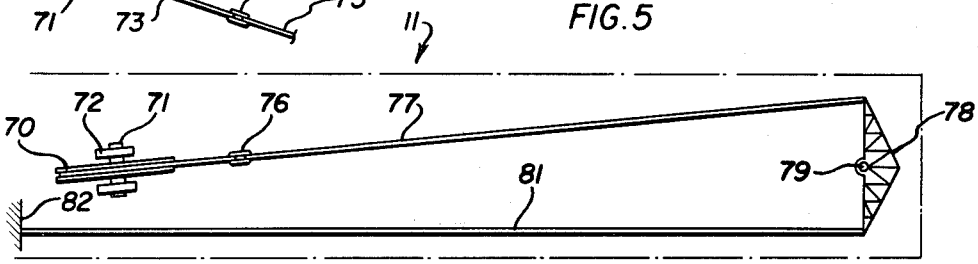
FIG. 5 is a plan view of the embodiment shown in FIG. 4.

The embodiment illustrated by FIGS. 4 and 5 can be located in boom 11. Sheave 70 is mounted on axle 71 supported by bearing blocks 72. Wire rope 73 runs over sheeve 70 and is connected by link 74 to hawser 75 which can extend to a ship to be moored. The upper end of wire rope 73 is joined by link 76 to one end of elastic line 77 and the other end of hawser 77 is connected to one end of lever 78. The middle of lever 78 is pivotally mounted on axle 79 supported by bearing block 80. Elastic line 81 extends from the other end of lever 78 to a secure base 82 to which it is attached.

It will be seen that the mechanical advantage achieved by the use of two differently sized sheaves in the embodiment shown in FIGS. 1 to 3, can be alternatively obtained by the use of a single sheave and a spaced-apart lever as shown in the embodiment of FIGS. 4 and 5. When force is applied to hawser 75 through mooring of a ship the elastic line 77 is placed in tension and stretches. This force is transferred by lever 78 to elastic line 81 which is placed in tension and stretches. Wire rope 73 thus can be paid out to a length equal to the sum of the distances each elastic line 77 and 81 stretches so that by making these lines long enough, a ship can be moored to an oscillating tower without subjecting the mooring hawser 75 to a breaking force. Nylon hawsers are particularly useful for the elastic lines 77 and 81 in this embodiment.

Figure 6:
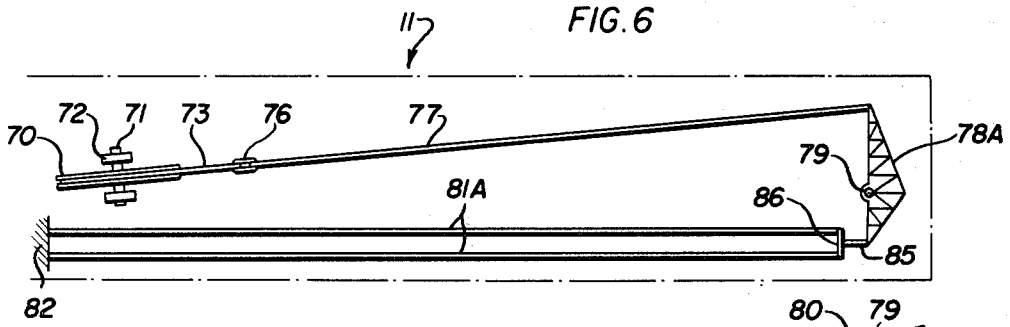
FIG. 6 is a plan view of a third embodiment of mooring line handling apparatus in a boom.
Figure 7:
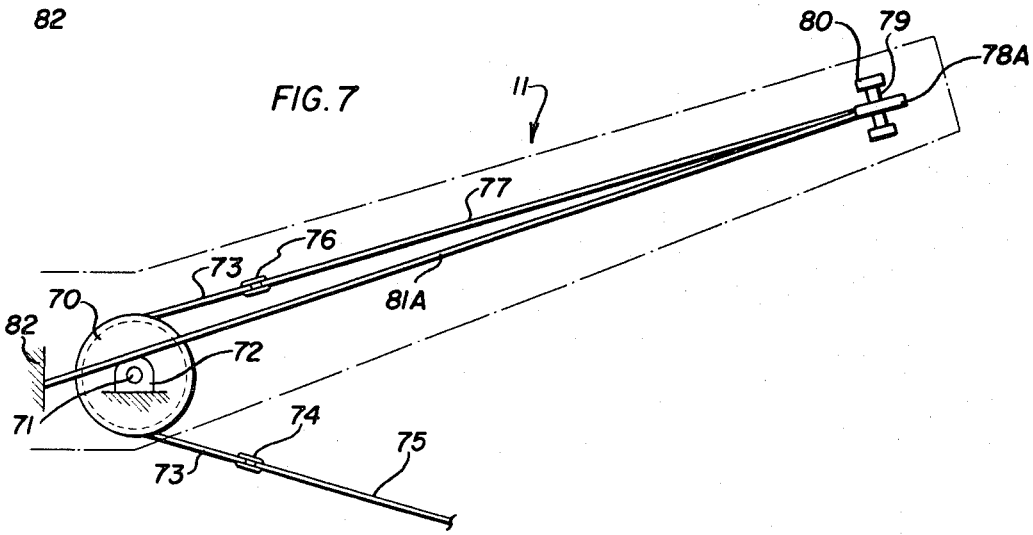
FIG. 7 is a side elevational view of the embodiment shown in FIG. 6.
Figure 8:
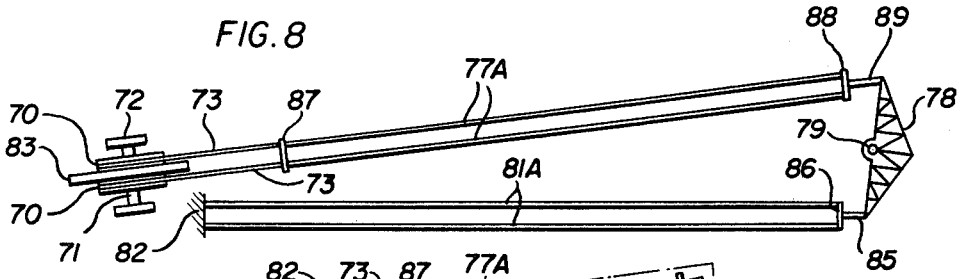
FIG. 8 is a plan view of a fourth embodiment of mooring line handling apparatus.
Figure 9:
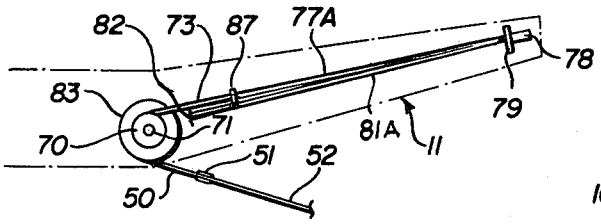
FIG. 9 is a side elevational view of the embodiment shown in FIG. 8.

The embodiment shown in FIGS. 6 and 7 is similar to the embodiment illustrated by FIGS. 4 and 5 with two differences. In the embodiment shown in FIGS. 6 and 7, the lever 78A is pivoted, instead of in the middle, at a point located two-thirds of the length of the lever measured from the end to which elastic line 77 is connected and one-third the length of the lever from the end to which rod 85 is joined. In addition, two elastic lines 81A are employed instead of one elastic line 81. The two elastic lines 81A are joined at one end to junction bar 86 which is connected to rod 85, and the other ends of elastic lines 81A are joined to base 82. Each of the elastic lines 77 and 81A may be nylon and of the same diameter or strength. Since the distance from the end of lever 78 A to which elastic line 77 is connected to the axle or pin 79 is twice the distance from the axle or pin 79 to the end of the lever to which rod 85 is attached the load applied by elastic line 77 is doubled on rod 85, and one-half of that load is borne by each elastic line 81A. In mooring a ship, the wire rope 73 can be paid out a distance equal to the sum of the distance which elastic line 77 stretches plus twice the distance stretched by elastic lines 81A as a unit. FIGS. 8 and 9 show an embodiment similar to the one shown in FIGS. 4 and 5 except that in the embodiment of FIGS. 8 and 9 small sheaves 70 and large sheave 83 are used to obtain a mechanical advantage. The elastic lines 77A are joined at one end to junction bar 87, which is attached to wire ropes 73, and at the other end to junction bar 88 to which rod 89 is connected at one end. The other end of rod 89 is joined to one end of lever 78 which is pivoted at its middle on pin or axle 79. Rod 85 is attached to the other end of lever 78 and to junction bar 86. Two elastic lines 81A extend from junction bar 86 to base 82.

The wire ropes 73 (FIGS. 8 and 9) extend from junction bar 87 to a pair of small sheaves 70 located one on each side of large sheave 83. The sheaves 70 and 83 are mounted on axle 71 supported in bearing blocks 72. Wire rope 50 is wound on large sheave 83 and it is connected by coupling or link 51 to mooring hawser 52.

The system of FIGS. 8 and 9 has a dual mechanical advantage obtained by the different sized sheaves and the lever. If a large sheave is used having a radius twice the radius of the small sheaves, the elongation at the output of the large sheave would equal the sum of the elongation of the four elastic lines stretched in the boom. By making the elastic lines long enough it can be readily seen that the hawser 52 can be paid out the required length to moor a ship namely, a length equal to one-half of the dynamic oscillation distance of a tower plus the amount of system elongation caused by the steady force pull of the ship, minus any elongation of the mooring hawser.

Figure 10:
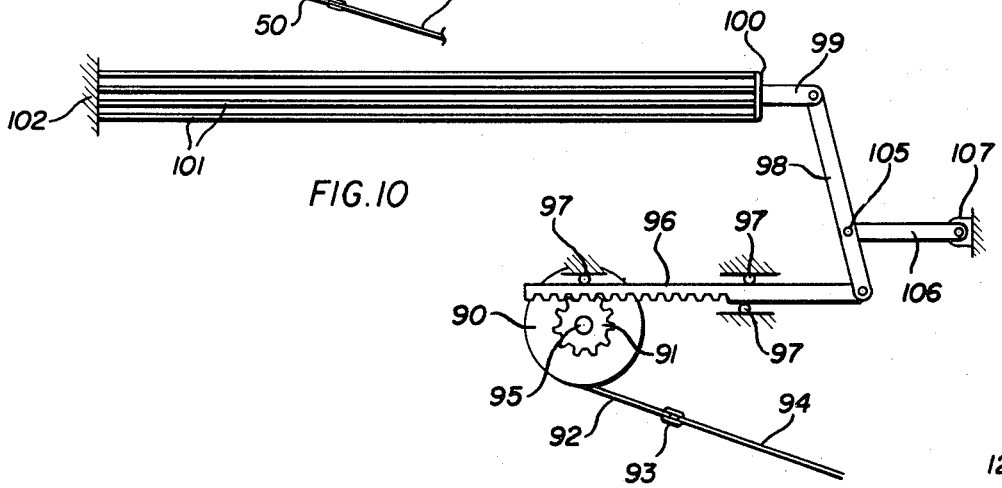
FIG. 10 is a schematic side elevational view of a fifth embodiment of mooring line handling apparatus.

The embodiment of FIG. 10 employs a large sheave 90 and a pinion gear 91. Wire rope 92 is wound on sheave 90 and by link 93 it is connected to hawser 94 which can be tied to a ship for mooring it. The sheave 90 and pinion gear 91 are mounted on axle 95. Bar gear 96 meshes with teeth in pinion gear 91 and it is held in a slidable path by guides 97. The end of bar gear 96 is pivotably joined to one end of lever 98 and the other end of lever 98 is pivotally joined to rod 99. Junction bar 100 is connected to the end of rod 99. Four elastic lines 101 are connected at one end to bar 100 and at the other end to stationary base or anchor 102. Arm 106 is joined at one end by pin 105 to lever 98 at a point located one-third of the length of the lever measured from the end to which gear bar 96 is joined. The other end of arm 106 is pivotally joined to stationary base 107.

When a moored ship is tied to hawser 94, oscillation of the mooring tower unwinds wire rope 92 from sheave 90 and thereby causes pinion gear 91 to rotate in the same direction. This causes bar gear 96 to move to the left, thereby pulling on one end of lever 98. The lever 98 reacts by applying force on rod 99 which, by means of junction bar 100, applies tension on elastic lines 101 causing them to stretch.

The embodiment shown in FIG. 10 has all of the advantages found in the first embodiment illustrated by FIGS. 1 to 3 plus the added mechanical advantage achieved by lever 98 in applying force to the elastic lines 101.

Figure 11:
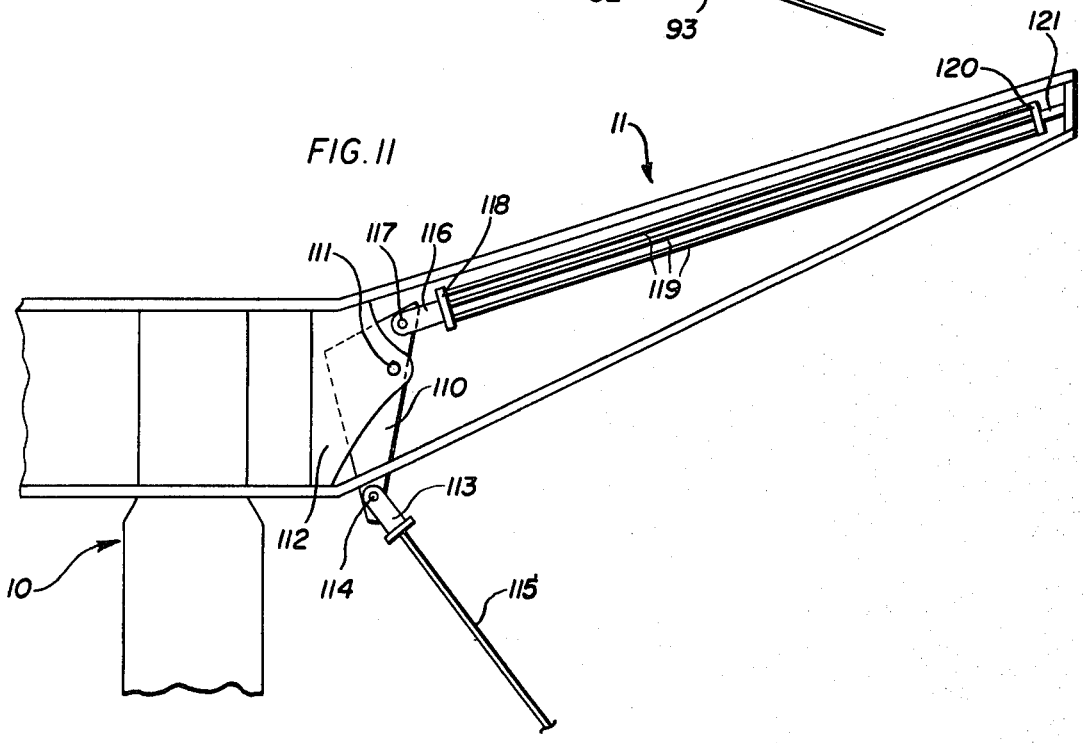
FIG. 11 is a side elevational view of a sixth embodiment of the invention.

FIG. 11 illustrates an embodiment of the invention in which a lever is used without a sheave. In this embodiment lever 110 is pivotally mounted by pin 111 to support bracket 112 in boom 11 on oscillating offshore tower 10. Arm 113 is joined by pin 114 to the lower end of lever 110 and hawser 115, for mooring a ship, is joined to the arm 113. Arm 116 is joined by pin 117 to the top end of lever 110. Junction bar 118 is connected to arm 116. Three elastic lines 119 such as nylon hawsers are connected at one end to junction bar 118 and at the other end to junction bar 120 which is joined to rod 121 fastened to the outer end of the boom 11.

The pivot pin 111 is positioned off-center on lever 110 so that a mechanical advantage, such as of about 4 or 5 to 1, is achieved by applying a load on the hawser 115 relative to the load transferred to arm 116 and the hawsers 119. In this way, the hawser 115 can be extended relative to the tower a distance equal to the linear displacement of pin 114 caused by a load applied to hawser 115. This distance will be about four or five times the distance moved by pin 117 by stretching of the nylon hawsers, or other suitable elastic lines. However, it is obvious that this ratio of mechanical advantage can be altered by repositioning pin 111 on the lever. Furthermore, the number of elastic lines or hawsers 119 can be varied as needed to achieve the desired balance based on the load calculated to be applied to hawser 115. Thus, only one or two elastic lines may be required for some loads and for higher loads three or more lines may be needed.

The following example is presented to further illustrate the invention.

EXAMPLE

Six nylon hawsers 43, 100 feet long and with a 21 inch circumference, are run in parallel from the end of the boom to eyes 42. Large sheave 23 has a diameter of 25 feet and pinion gears 21 have a diameter of about 4.2 feet and a width of 2 feet. About 100 feet of wire rope 50 is spooled onto large sheave 23 and the wire rope is coupled to about 170 feet of nylon hawser 52 having a 21 inch circumference. During a maximum design operating case a tanker moored to the tower 10 exerts a steady force of 195 kips on the tower which has a maximum horizontal motion of about 34 feet. The ship's steady force of 195 kips causes the hawser system to elongate about 43 feet up to coupling 53. This same steady force causes a system elongation of about 33.5 feet up to coupling 51 which causes an elongation of about 5.6 feet ($33.5 \times 4.2/25$) in the hawsers 43. The horizontal tower 10 motion of 34 feet will approximately oscillate about the extension of the system caused by the tanker steady force, which means that the maximum extension of the hawser system at coupling 53 will be about 60 feet ($43+34/2$) and the minimum extension will be about 26 feet ($43-34/2$). The maximum load caused by the maximum extension of 60 feet is approximately 300 kips which is well below the elastic limitation of the mooring line apparatus 20. The following table illustrates the amount hawser 52 effectively increases in length, with increased load applied thereto, by the unspooling of wire rope 50 from the large sheave.

| T Hawser Tension (kips) | E Hawser Line Elongation (ft) | T/ E(Kips/Ft) |
|---|---|---|
| 5 | .3 | 3.60 |
| 31.5 | 7.66 | 3.84 |
| 63.0 | 15.68 | 4.55 |
| 94.5 | 22.79 | 4.76 |
| 126.0 | 29.41 | 4.98 |
| 157.5 | 35.73 | 5.18 |
| 189.0 | 41.81 | 5.53 |
| 220.5 | 47.51 | 6.20 |
| 252.0 | 52.59 | 7.05 |
| 283.5 | 57.06 | 7.59 |
| 315.0 | 61.21 | 7.86 |
| 346.5 | 65.22 | 8.18 |
| 378.0 | 69.07 | 8.18 |
| 400.0 | 71.76 | |

The foregoing detailed description has been given for clearness of understanding only, and no unnecessary limitations should be understood therefrom as modifications will be obvious to those skilled in the art.

What is claimed is:

1. A mooring line handling apparatus comprising:

a sheave axially mounted on a shaft secured to a base, a first line wrapped for at least part of its length on the sheave, at least one first elastic line extending from the first line to one end of a pivotally mounted lever, and at least one second elastic line extending from the other end of the lever to an anchor means;

whereby said at least one first elastic line and at least one second elastic line resist, by means of the elasticity of the elastic lines means, unwrapping of the first line from the sheave when a load is applied to the first line.

2. A mooring line handling apparatus according to claim 1 in which the lever is pivotally mounted an equal distance from each end.

3. A mooring line handling apparatus according to claim 1 in which the lever is pivotally mounted on unequal distance from the lever ends.

* * * * *

UNITED STATES PATENT AND TRADEMARK OFFICE

CERTIFICATE OF CORRECTION

PATENT NO. : 4,317,421

DATED : March 2, 1982

INVENTOR(S) : JACK POLLACK

Figure 12:
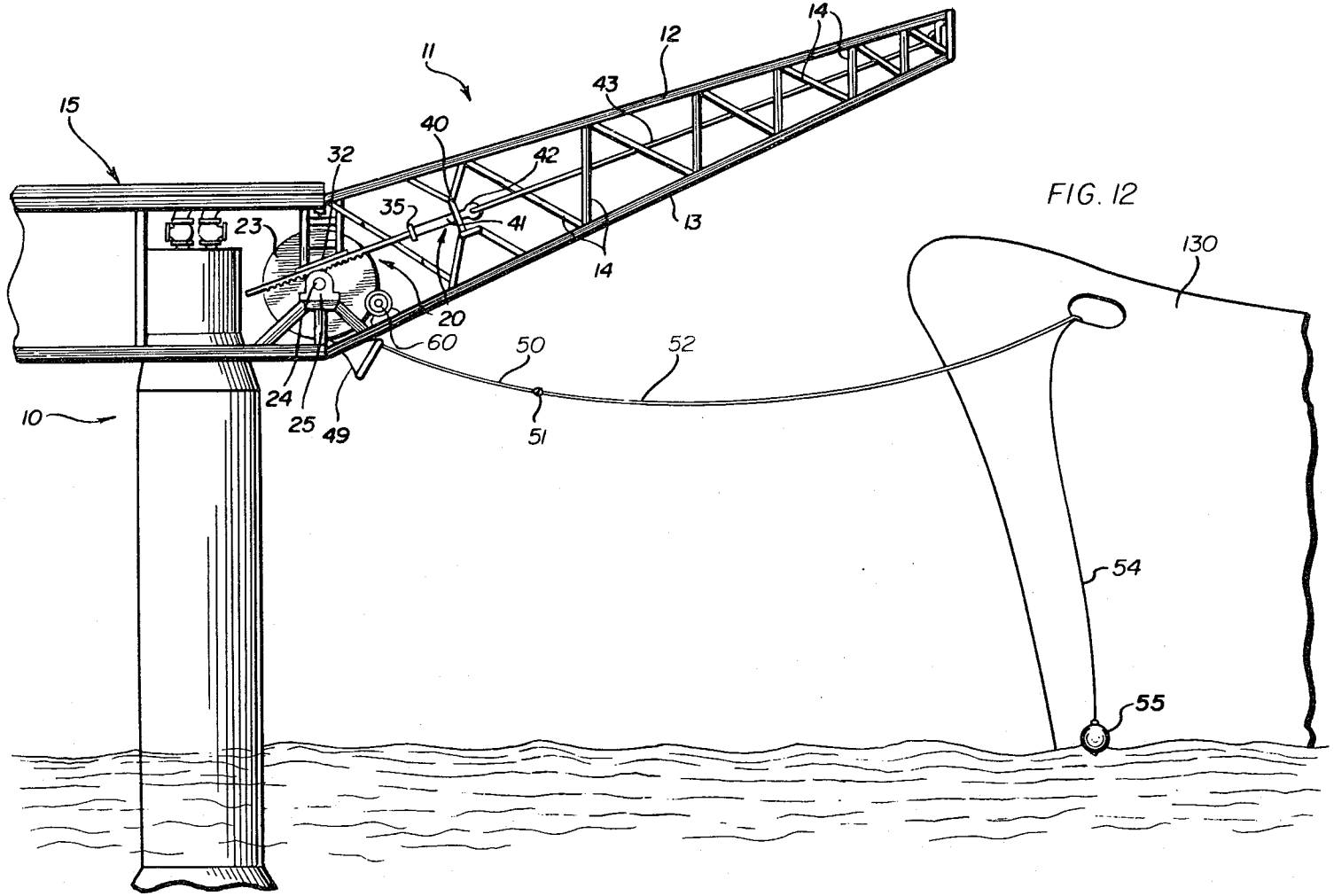
FIG. 12 is a substantially identical to FIG. 1 but also shows a moored ship.

It is certified that error appears in the above-identified patent and that said Letters Patent are hereby corrected as shown below:

Column 4, line 18, change "thimble 46." to --thimble 45.--; line 50, change "FIG. 2," to --FIG. 12,--; column 5, line 65, start a new paragraph with "Figs. 8 and 9"; column 8, line 45, change "on" to --an--.

Signed and Sealed this

*Fourth* Day of *May 1982*

[SEAL]

*Attest:*

GERALD J. MOSSINGHOFF

*Attesting Officer*

*Commissioner of Patents and Trademarks*